US005333570A

United States Patent [19]

DuBois et al.

[11] Patent Number: 5,333,570

[45] Date of Patent: Aug. 2, 1994

[54] DAMPED LINKAGE FOR TORPEDO STEERING ACTUATOR

[75] Inventors: Neil J. DuBois, Cranston; Stanley J. Polhemus, Wakefield, both of R.I.

[73] Assignee: The United States of America as represented by the Secretary of the Navy, Washington, D.C.

[21] Appl. No.: 884,813

[22] Filed: May 18, 1992

[51] Int. Cl.[5] ..... B63H 25/00

[52] U.S. Cl. ..... 114/144 R; 114/330; 440/52; 74/470

[58] Field of Search ..... 440/51-53, 440/61-63, 66; 114/144 R, 162, 163, 164, 330-332, 23; 74/470

[56] References Cited

U.S. PATENT DOCUMENTS 1,859,038 5/1932 Irgens ..... 74/470
2,772,649 12/1956 Gensheimer et al. ..... 440/52
4,732,100 3/1988 Dobbs ..... 114/144 R
5,176,549 1/1993 Ross ..... 440/63

*Primary Examiner*—Jesus D. Sotelo
*Attorney, Agent, or Firm*—Michael J. McGowan; Prithvi C. Lall; Michael F. Oglo

[57] ABSTRACT

The present invention relates to a damped actuator linkage for use on an underwater vehicle. The linkage includes a first linkage member connected to an actuator for providing a torsional force, a second linkage member connected to a utility device, and a layer of non-metallic material interposed between the first and second linkage members to reduce the transmission of noise and the attenuation of vibrations. The non-metallic material layer may be a layer of polyurethane material or a layer of silicone compound. This layer is preferably cast in concentric arrangement between the two linkage members.

15 Claims, 1 Drawing Sheet

DAMPED LINKAGE FOR TORPEDO STEERING ACTUATOR

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (*a*) Field of the Invention

The present invention relates to an actuator linkage and more particularly to a damped actuator linkage for use on underwater vehicles for reducing the transmission of noise and vibrations.

(*b*) Statement of Prior Art

Actuators are used in a variety of underwater vehicles such as submarines and torpedoes for providing the torque required to turn a control steering fin. Typically, this torque is transmitted to the fin shaft via a linkage. Current linkages used for this purpose are solid metal. While they function adequately as force transfer mechanisms, they also transfer acoustic energy which eventually finds its way into the water as radiated noise. This noise path is significant in those situations where it is desired to reduce the detectability of a vehicle. Linkagesor couplings containing non-metallic components are known in the art. U.S. Pat. No. 3,879,959 to Clampett, for example, illustrates a flexible coupling for connecting a steering shaft to a steering gear. The coupling includes identical interchangeable first and second stamped metal yokes of a generally U-shape. The yokes are nested together with a rubber member interposed therebetween. The rubber member has a plurality of outwardly extending flanges which engage the yokes and provide a driving connection from one yoke to another.

U.S. Pat. No. 4,232,563 to Peterson et al. illustrates end bearing assemblies for articulating links such as control links associated with helicopter rotor mechanisms. The end bearing assemblies comprise at least two elastomeric bearing sections connected by a load-transmitting member and are arranged to react to loadings and accommodate motions along and about at least one of three mutually orthogonal axes. The bearing sections are formed by interleaving elastomeric material and metal shim layers.

It is know in the art to provide shock absorbers on propulsion devices for water vehicles. U.S. Pat. No. 4,642,057 to Frazell et al., for example, illustrates one such propeller wherein an elastomeric shock absorbing member is interposed between the hub carrying the propeller blades and the propeller shaft. U.S. Pat. No. 4,938,723 to Yoshimura et al. illustrates a similar arrangement.

U.S. Pat. No. 4,747,796 to Iwai et al. illustrates a coupling device for marine outboard drives for providing a coupling between an engine output shaft and the outboard drive. In certain embodiments shown therein, elastomeric elements are used to provide the driving connection.

None of these linkages however are designed specifically to be used on an underwater vehicle for controlling utility devices such as steering fins and for attenuating the acoustic energy produced by the actuator itself.

SUMMARY OF THE INVENTION

It is an object of the present invention to provide a damped actuator linkage for use on underwater vehicles.

It is a further object of the present invention to provide a damped actuator linkage as above having a layer of damping material integral with the actuator linkage for attenuating the acoustic energy produced by the actuator itself.

Other objects and advantages will become more apparent from the following description and drawings wherein like reference numerals depict like elements.

The foregoing objects are attained by the damped actuator linkage of the present invention which comprises a first linkage member connected to an actuator for providing a torsional force, a second linkage member connected to a utility device such as a control shaft for a steering control fin, and a means for reducing noise and attenuating vibrations caused by the actuator positioned between the first and second linkage members. The noise reducing and vibration attenuating means comprises at least one layer of damping material cast in concentric arrangement between the two linkage members. The damping material may comprise any suitable damping material known in the art. Preferred damping materials include polyurethane or a silicone compound.

Other features of the present invention are set out in the following description.

DETAILED DESCRIPTION OF THE INVENTION

Figure 1:
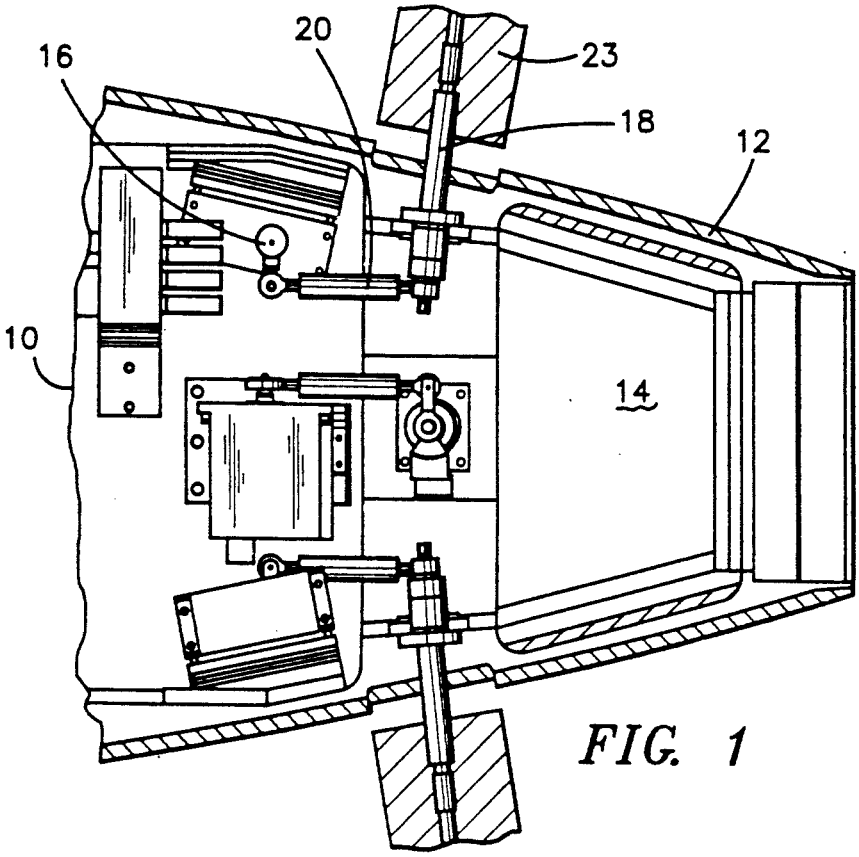
FIG. 1 is a cross sectional view of an afterbody portion of an underwater vehicle illustrating the linkage for operating a steering control fin shaft.

FIG. 1 illustrates the afterbody portion or tailcone 10 of an underwater vehicle (not shown) such as a torpedo. The tailcone 10 has an outer hull 12 and an inner compartment 14 wherein an actuator 16 is located for causing movement of a utility device such as a steering control fin 23. A control shaft 18 extends through the hull 12 and is connected to a steering control fin 23. The shaft 18 is used to cause changes in the angular position of the steering fin. Angular position changes of the steering fin are caused by the mechanical transmission or transference of a torsional force or torque from the actuator 16 to the shaft 18 via a linkage 20.

As discussed hereinbefore, typically the linkage between an actuator and a steering fin control shaft is formed from all metal components. While such linkages function adequately as force transfer mechanisms, being metal they are also good transmitters of acoustic energy and vibrations caused by the actuator. This acoustic energy and these vibrations eventually find their way into the water as radiated noise. This is a highly undesirable occurrence in those situations where one is trying to minimize or eliminate such noise.

Figure 2:
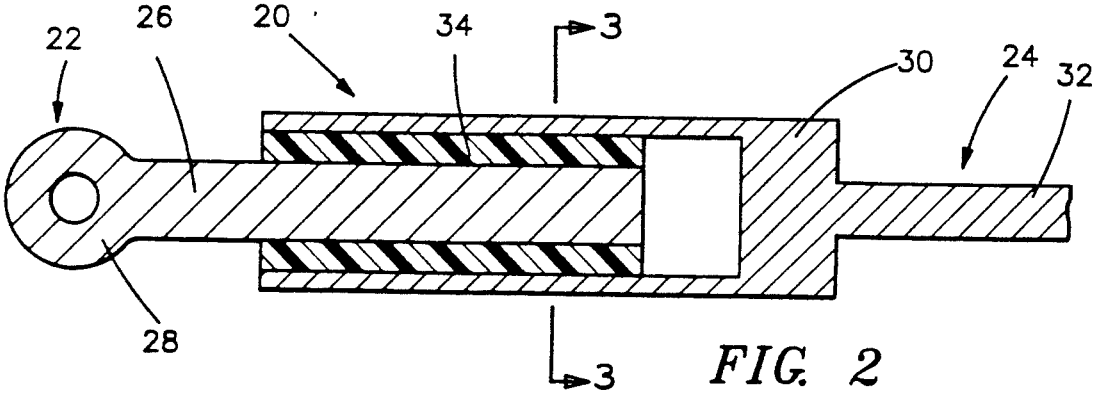
FIG. 2 is a sectional view of a damped actuator linkage in accordance with the present invention.

FIG. 2 illustrates a damped actuator linkage 20 in accordance with the present invention. The linkage 20 attenuates the acoustic energy and vibrations caused by the actuator 16 and thereby reduces noise levels. As can be seen from this figure, the linkage 20 includes a first linkage member 22 to be connected to the actuator 16 and a second linkage member 24 to be connected to the shaft 18. The linkage members 22 and 24 may be connected to the actuator 16 and the shaft 18 respectively using any suitable connection device known in the art. For example, rigid moment arms, ball joints and the like may be used to form the desired connection.

Figure 3:
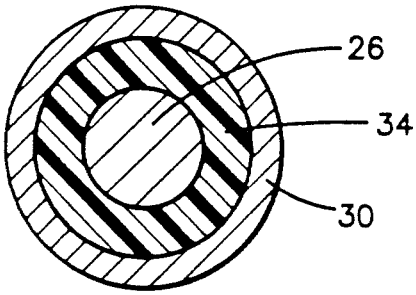
FIG. 3 is a sectional view taken along lines 3—3 of FIG. 2.

As can be seen from FIG. 2 and 3, the linkage member 22 has a solid cylindrical portion 26 and an actuator connection portion 28, while the linkage member 24 has a hollow cylindrical portion 30 into which the solid cylindrical portion 26 of member 22 is at least partially inserted, and a shaft connection portion 32. The solid cylindrical portion 26 extends into the hollow cylindrical portion 30 and has a preselected diameter which is less than a preselected diameter for the hollow cylindrical portion 30. Interposed between the solid cylindrical portion 26 and the hollow cylindrical portion 30 is a layer 34 of non-metallic damping material in the form of a cylindrical sleeve. As can be seen from these figures, the layer 34, preferably substantially surrounds the solid cylindrical portion 26 of the linkage member 22. Additionally, it is completely housed or positioned entirely within the hollow cylindrical portion 30 of the linkage member 24. By providing such a damping material layer, direct metal-to-metal contact between the linkage members 22 and 24 can be avoided. As a result, there is no path for acoustic energy and vibrations from the actuator to flow through the linkage and the control shaft into the water.

In a first embodiment of the present invention, the damping material layer 34 comprises an integral polyurethane layer which is cast in concentric arrangement between the two portions 26 and 30. The urethane is selected from a range of polyurethanes having measured values of damping between 0.1 and 0.5. The cast layer 34 may be formed by placing the linkage members 22 and 24 in a mold (not shown) and pouring urethane into the mold between the linkage members. The urethane material is then allowed to cure. The resulting layer of urethane is firmly adhered to both an outer surface of the solid cylindrical portion 26 and an inner surface of the hollow cylindrical portion 30. If needed, a primer such as PRC 420 may be applied to the portions 26 and 30 prior to pouring the urethane into the mold between the two portions. The thickness and the length of the thus formed cast polyurethane layer can be adjusted as desired to provide a desired level of rigidity to the linkage. Any of a number of well know equations for stiffness of elastomeric bushings can be used to size the linkage, e.g., page 226 of *Design of Machine Elements by Spotts,* Fifth Edition, Prentice Hall Publishing Co.

In an alternative embodiment of the present invention, the damping material layer 34 comprises a layer of silicone compound. Such a damping material would be preferably used in high temperature applications. The silicone compound layer may be cast in a concentric arrangement between the portions 26 and 30 in the manner previously described.

While it is preferred that the layer 34 be a single layer, it should be recognized that it could be broken into two or more layers if so desired. For example, two concentric layers of damping material in direct contact with each other could be used to obtain an increased attenuation performance.

The linkage members 22 and 24 may be formed from any suitable metallic or composite material known in the art. For example, they could be fabricated from aluminum with a layer of Uralite 3130 polyurethane. Alternatively, they could be made of steel or any other suitable structural material.

While the elements of the damped actuator linkage of the present invention have been illustrated as having a particular geometry, it should be recognized that the invention lends itself to a variety of different geometries. For example, the linkage members 22 and 24 could have a rectangular or square cross section and the layer 34 could have a similar configuration.

As can be seen from the foregoing description, the present invention accomplishes the objects set out hereinbefore. The damped actuator linkage of the present invention has the advantage of being able to attenuate acoustic energy before it is released to the environment via a utility device such as a control fin shaft. This is accomplished through the innovative use of an integral layer of damping material cast in concentric arrangement with the connecting linkage members.

It is apparent that there has been provided in accordance with this invention a damped linkage for a torpedo steering actuator which fully satisfies the objects, means and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

What is claimed is:

1. A damped actuator linkage for use on an underwater vehicle for providing torque from an actuator to a utility device, said linkage comprising:

a first linkage member connected to said actuator;

a second linkage member connected to said utility device;

said utility device comprising a control shaft for causing movement of a control fin on said underwater vehicle; and means for reducing noise and attenuating vibrations positioned between said first and second linkage members and forming the sole connection between said first and second linkage members, said noise reducing and vibration attenuating means surrounding said first linkage member so as to prevent direct contact between said first and second linkage members and thereby substantially eliminate any path for acoustic energy and vibrations from the actuator to flow through said linkage members and said control shaft into water surrounding said vehicle.

2. The damped actuator linkage of claim 1 wherein:

said second linkage member has a hollow cylindrical portion of first preselected diameter; and said first linkage member has a solid cylindrical portion which extends into said hollow cylindrical portion, said solid cylindrical portion having a second preselected diameter less than said first diameter.

3. The damped actuator linkage of claim 2 wherein said noise reducing and vibration attenuating means is positioned entirely within the hollow cylindrical portion.

4. The damped actuator linkage of claim 3 wherein said noise reducing means and vibration attenuating means comprises at least one layer of polyurethane material.

5. The damped actuator linkage of claim 4 wherein said at least one layer of polyurethane material is cast in concentric arrangement about said solid cylindrical portion of said first linkage member and adheres to both an outer surface of said solid cylindrical portion and an inner surface of said hollow cylindrical portion.

6. The damped actuator linkage of claim 3 wherein said noise reducing and vibration attenuating means comprises at least one layer of silicone compound.

7. The damped actuator linkage of claim 3 wherein both said first and second linkage members are formed from a metallic material and said noise reducing and vibration attenuating means is formed solely from a non-metallic material.

8. The damped actuator linkage of claim 1 further comprising:

said control fin comprising a steering fin; and said control shaft comprising a shaft for controlling the angular position of said steering fin.

9. The damped actuator linkage of claim 1 wherein said noise reducing and vibration attenuating means has a thickness and a length sufficient to provide a desired rigidity in the linkage while maintaining a desired set of attenuation properties for the linkage.

10. An underwater vehicle having control fins for steering said vehicle and means for providing a torsional force to said control fins to steer said vehicle in a desired direction, said vehicle further comprising:

a linkage between a control shaft connected to said control fins and said torsional force providing means;

said linkage including a first linkage member connected to said torsional force providing means and a second linkage member connected to said control shaft;

said linkage further including means for reducing noise and attenuating vibrations between said first and second linkage members;

said noise reducing and vibration attenuating means forming the sole connection between the first and second linkage members; and said noise reducing and vibration attenuating means comprising an integral layer of non-metallic material cast in concentric arrangement between the first and second linkage members, said cast layer of non-metallic material substantially eliminating any path for acoustic energy and vibrations from the torsional force providing means to flow through said linkage members and said control shaft into a fluid surrounding said vehicle.

11. The underwater vehicle of claim 10 wherein said non-metallic material comprises a polyurethane material.

12. The underwater vehicle of claim 10 wherein said non-metallic material comprises a silicone compound suitable for use in a high temperature application.

13. The underwater vehicle of claim 10 wherein said integral layer of non-metallic material comprises two concentric layers of non-metallic material in direct contact with each other.

14. The underwater vehicle of claim 10 further comprising:

said first linkage member having a cylindrical portion;

said second linkage member having a hollow cylindrical portion; and said noise reducing and vibration attenuating means comprising a cylindrical sleeve of said non-metallic material positioned entirely within said hollow cylindrical portion and surrounding said cylindrical portion of said first linkage member.

15. The underwater vehicle of claim 14 wherein said first linkage member has means for connecting said first linkage member to said torque providing means and said second linkage member has means for connecting said second linkage member to said control shaft.

* * * * *